US006318445B1

(12) United States Patent
Smorynski et al.

(10) Patent No.: US 6,318,445 B1
(45) Date of Patent: Nov. 20, 2001

(54) RISER TOPPING GATHERING SYSTEM AND METHOD

(75) Inventors: Michael E. Smorynski, Cary; Craig L. Peters, Western Springs; Greg M. Morris, Chicago, all of IL (US); Frank E. Arthurs, Senecaville, OH (US)

(73) Assignee: AMSTED Industries Incorporated, Chicago, IL (US)

( * ) Notice: Subject to any disclaimer, the term of this patent is extended or adjusted under 35 U.S.C. 154(b) by 0 days.

(21) Appl. No.: 09/602,429

(22) Filed: Jun. 23, 2000

(51) Int. Cl.[7] ..... B22D 29/00; B22D 17/06

(52) U.S. Cl. ..... 164/131; 164/403; 164/344

(58) Field of Search ..... 164/131, 344, 164/404, 403, 408; 134/21, 24

(56) References Cited

U.S. PATENT DOCUMENTS

| | | | | |
|---|---|---|---|---|
| 1,311,866 | * | 8/1919 | Armstrong | 29/423 |
| 1,475,989 | | 12/1923 | Easterday . | |
| 2,193,999 | | 3/1940 | Allen . | |
| 2,637,872 | | 5/1953 | Holbrook . | |
| 3,280,415 | * | 10/1966 | Moore et al. | 15/4 |

FOREIGN PATENT DOCUMENTS

| | | | |
|---|---|---|---|
| 1508609 | | 2/1971 | (DE) . |
| 2222794-A | * | 3/1990 | (GB) . |
| 2222794 | | 3/1990 | (GB) . |
| 6-91348 | | 4/1994 | (JP) . |

* cited by examiner

*Primary Examiner*—Tom Dunn
*Assistant Examiner*—Kevin McHenry
(74) *Attorney, Agent, or Firm*—Edward J. Brosius

(57) ABSTRACT

A riser topping gathering system and method are disclosed. The system and method are used in gathering riser topping material from the riser cavities of the cope portion of a mold. A capture hood includes high-pressure air outlets and is connected to a duct system, collector and air moving mechanism. The capture hood is moved into contact with the top of the cope mold portion. The air moving mechanism pulls a stream of ambient air over the top of the cope mold portion while high pressure air is pulsed into the riser cavities through the high air pressure outlets. The pulses of high-pressure air activate the riser topping materials and raise them out of the riser cavities and into the path of the ambient air in the capture hood. The moving ambient air carries the riser topping material out of the capture hood and into the duct system. The air and riser topping material is moved to the collector where the riser topping material is separated from the air. The riser topping material may then be gathered from the collector and disposed of or recycled. The cope mold portion may then be moved to another workstation for removal of the risers from the riser cavities.

20 Claims, 4 Drawing Sheets

RISER TOPPING GATHERING SYSTEM AND METHOD

BACKGROUND OF THE INVENTION

1. Field of the Invention

The present invention relates to casting metal objects in molds that have riser cavities and riser toppings in the riser cavities, and to the problems associated with the use of riser toppings.

2. Description of the Art

In some metal molding processes, such as those used in casting steel railroad wheels, a solid graphite mold is used, with both cope and drag portions. Such molds are designed to be reused after a cast wheel has been removed from the mold. The cope mold portion, that is the top portion, typically has riser cavities. Such riser cavities typically have generally vertically-disposed cylindrical walls, and are open at both the tops and bottoms of the cavities. Prior to casting, a sand coating is typically baked onto parts of the walls of the riser cavities. During casting of the wheel, a reservoir of molten metal forms in the riser cavity attached to the wheel casting to compensate for internal contraction of the casting during solidification. After the metal is poured, a riser topping material is typically placed in the open top of the riser cavity on top of the molten metal in the riser. Riser toppings provide an insulating effect and reduce heat loss from convection and radiation. Compounds that serve as such insulators include powdered graphite, coke breeze, charcoal, rice or oat hulls and various combinations of refractory powders. After the cast wheel is removed from the mold, there is a waste metal riser left in the riser opening, as well as waste riser topping material. Before the cope portion of the mold is used again, the waste riser and waste riser topping material must be removed from the riser cavity, and the baked sand coating must be removed.

In one prior art system, the waste metal riser and waste riser topping material are knocked out of the riser opening by a plunger assembly. In that system, there are brushes attached to solid plungers that are driven through the riser cavities of the cope portion of the mold. The plungers push the waste risers out through the bottoms of the riser cavities, the riser topping materials drop out through the bottoms of the riser cavities, and the brushes clean the cylindrical side walls of the riser cavities, brushing off the baked sand coating on the walls of the riser cavities. In this system, the waste risers and some of the riser topping materials drop through a chute in the mill floor below the apparatus. There are hoppers in the basement under the mill floor and riser knock out station. Deflector bars beneath the mill floor deflect the waste risers to one hopper and allow sand and riser topping to drop to a second hopper. However, quantities of riser topping material also frequently fall to the mill floor. In another prior system, the surface of the cope mold portion is cleaned with high pressure air streams which blow any riser topping materials off of the cope mold portion surface. The waste metal risers may be knocked out in a separate operation and the waster metal risers and riser topping materials may then be gathered from separate hoppers below the mill floor, and the waste metal risers may be recycled. However, quantities of riser topping material also frequently fall to the mill floor. With these prior systems, the riser topping materials, such as the rice hulls, create potential maintenance and safety problems. The hulls or other riser topping material can get into the plant machinery, such as the conveyor, and dust from the riser toppings can get into the workers' eyes, for example. In addition, the waste riser topping material must be gathered up from the mill floor in a labor-intensive operation.

In typical production, the cope mold sections are recycled for reuse after the risers have been pushed out of the riser cavities.

BRIEF SUMMARY OF THE INVENTION

The present invention provides a riser topping gathering system and a method that may be used to gather the riser topping materials. The system and method may also be used to gather other loose materials.

BRIEF DESCRIPTION OF THE DRAWINGS

In the figures of the Drawings, like reference numerals identify like components and.

DETAILED DESCRIPTION

Figure 1:
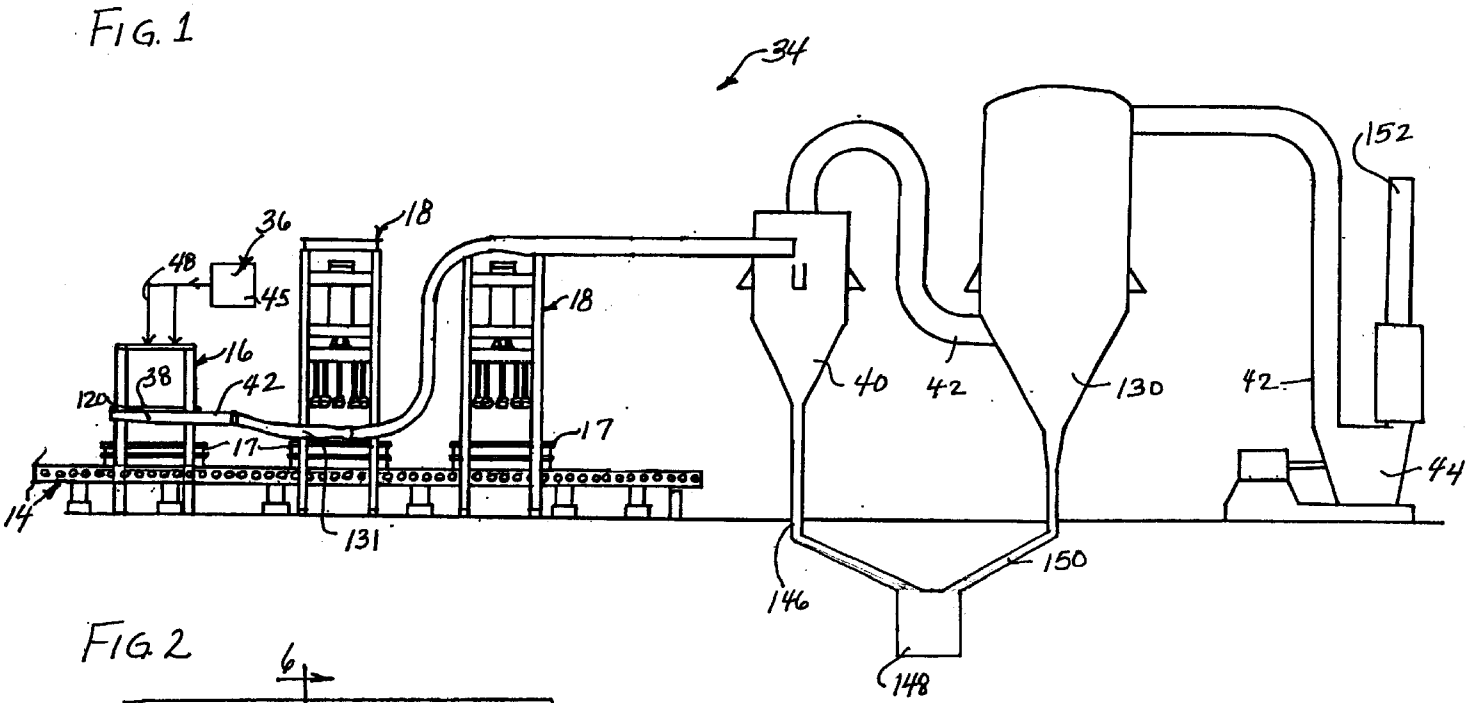
FIG. 1 is a side elevation view of a part of a foundry showing the riser topping gathering system of the present invention in a production line with some other systems of the foundry.
Figure 1A:
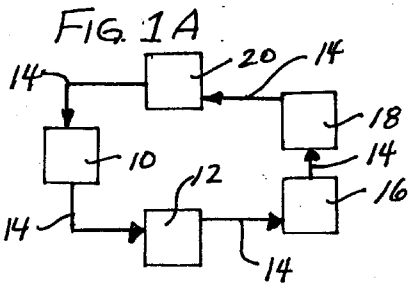
FIG. 1A is a schematic view of the riser topping gathering station and other stations in the production line of the foundry.

An example of a site in which the present invention has utility is illustrated in side elevation in FIG. 1 and schematically in FIG. 1A. The illustrated site is a foundry for the production of cast steel railway wheels. It should be understood that this use is presented for purposes of illustration only, and that the present invention is not limited to the illustrated and described site and use unless expressly set forth in the claims.

The illustrated foundry has a station 10, shown schematically in FIG. 1A, for casting the steel railway wheels. The wheels are cast in a two-piece mold, the mold having cope and drag portions. Downstream from the casting station 10, the cope and drag portions of the mold are separated at a splitter or second station 12. From this splitter station 12, the cope portion of the mold is moved along a conveyor 14. The cope portion of the mold is shown at 17 in FIG. 1. The illustrated foundry incorporates the present invention: a riser topping gathering station 16 is provided. The cope mold portion 17 is moved along the conveyor 14 from the splitter station 12 to the riser topping gathering station 16. After passing through riser topping gathering station 16, the cope portion 17 of the mold passes along the conveyor 14 to one of two riser removal stations 18. From the riser removal station 18, the cope mold portion 17 is moved along the conveyor 14 to one or more additional treatment stations, shown schematically at 20 in FIG. 1A, where the solid graphite mold surfaces may be cleaned and machined and the riser cavities may be filled with core sand and baked, and the cope mold portion 17 combined with a drag mold portion (not shown). The combination cope and drag mold portions may then be conveyed again to the casting station 10, and the process repeated until the cope and drag mold portions have gone through several cycles. After a number of cycles, the steel flask parts of the cope and drag mold portions may be recycled and the old graphite may be scrapped or recycled. To achieve maximum efficiency in this manufacturing cycle, it is desirable that the dwell time at any of the non-casting stations 12, 16, 18, 20 be kept to a minimum so that the operations performed at these stations do not slow down the casting operations.

Figure 2:
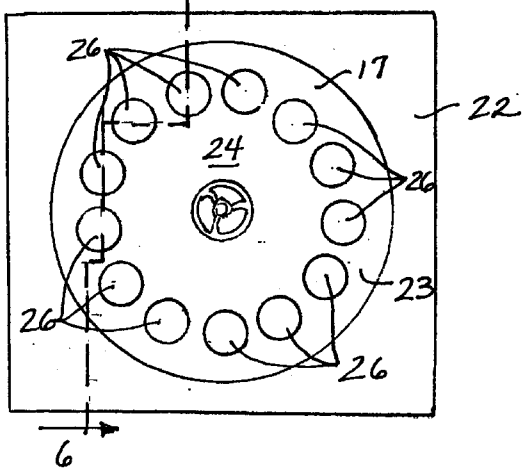
FIG. 2 is a top plan view of a cope portion of a mold.
Figure 6:
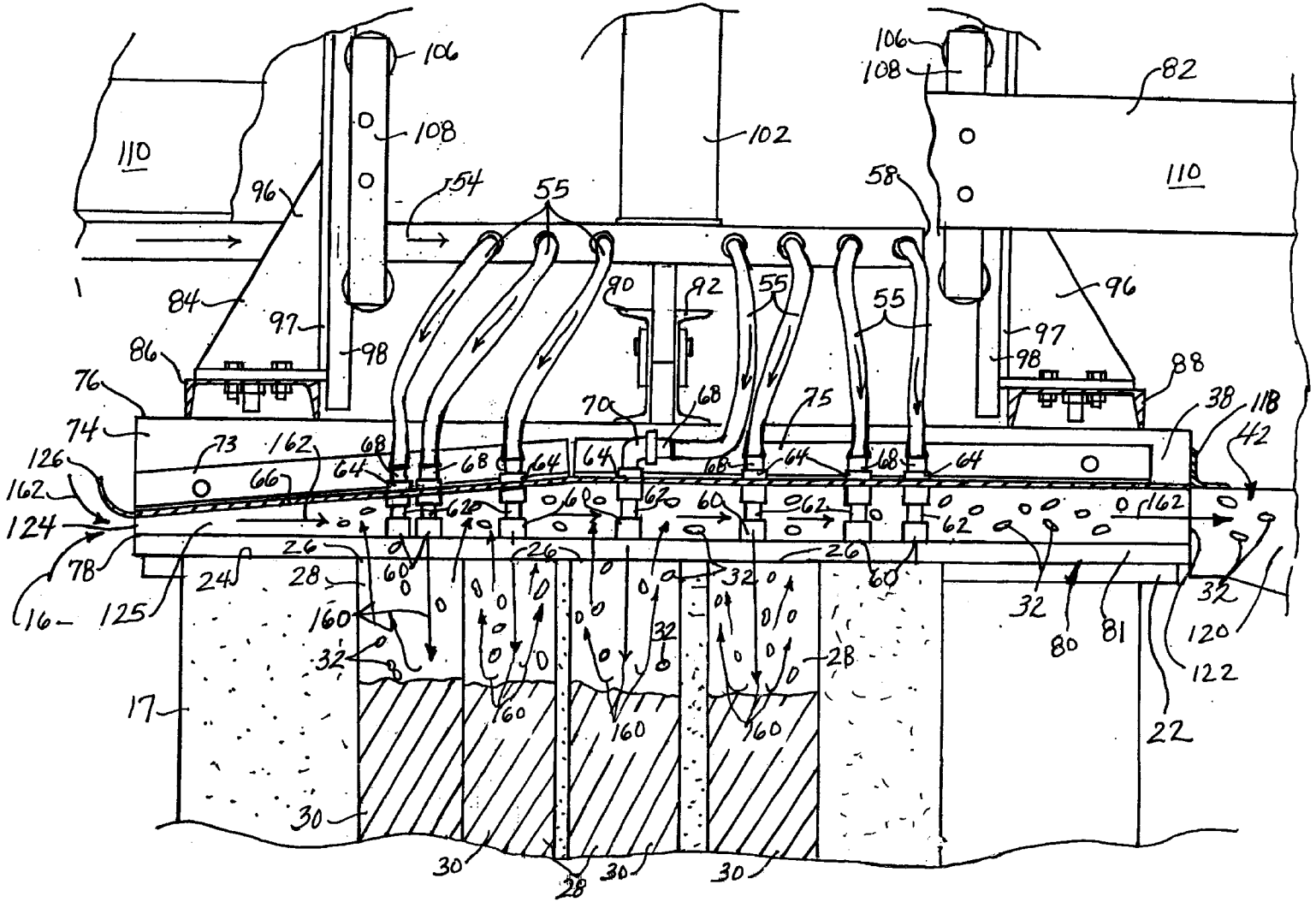
FIG. 6 is a side elevation of part of the riser topping gathering apparatus of FIGS. 3–5, shown with the capture hood in a lowered position, and with the capture hood shown in cross-section along line 6—6 of FIG. 5, and with four of the riser cavities of the cope portion of the mold shown in cross-section, the cross section of the cope mold portion being taken along line 6—6 of FIG. 2.

FIG. 2 illustrates an example of a cope mold portion 17 in top plan view, with a flask 22 surrounding a graphite element 23 of the cope mold portion 17. As shown, the cope mold portion 17 has a top 24 with a plurality of openings 26 in the top 24. The top 24 of the cope mold portion 17 includes both the top surface of the graphite portion 23 and the top surface of the flask 22. Each opening 26 in the top is vertically aligned with a riser cavity extending through the height of the cope mold portion. Examples of riser cavities are shown at 28 in FIGS. 3 and 6. The cross-section through the cope mold portion 17 in FIG. 6 is taken along line 6—6 of FIG. 2. In the illustrated embodiment, there are 13 openings corresponding with 13 riser cavities, but it should be understood that the number and position of the riser cavities and openings may vary depending upon the product being cast. The present invention is not limited to any particular number or pattern of riser cavities or openings unless expressly set forth in the claims. The illustrated cope mold portion 17 is the cope portion of a standard re-usable graphite mold, wherein the graphite is bonded into solid form. However, the present invention is not limited to any particular type of mold unless expressly set forth in the claims.

During casting, liquid metal rises in the riser cavities 28 and feeds metal to the casting as the casting solidifies and contracts. To limit heat loss, a riser topping material is placed in each opening 26 of the cope mold portion 17. Riser toppings provide an insulating effect and reduce heat loss by convection and radiation. Compounds that serve as such insulators include powdered graphite, coke breeze, charcoal, rice or oat hulls and various combinations of refractory powders. As used herein, "riser topping" and "riser topping material" should be understood to include all of these materials, as well as any other material suitable for use for this purpose.

Figure 3:
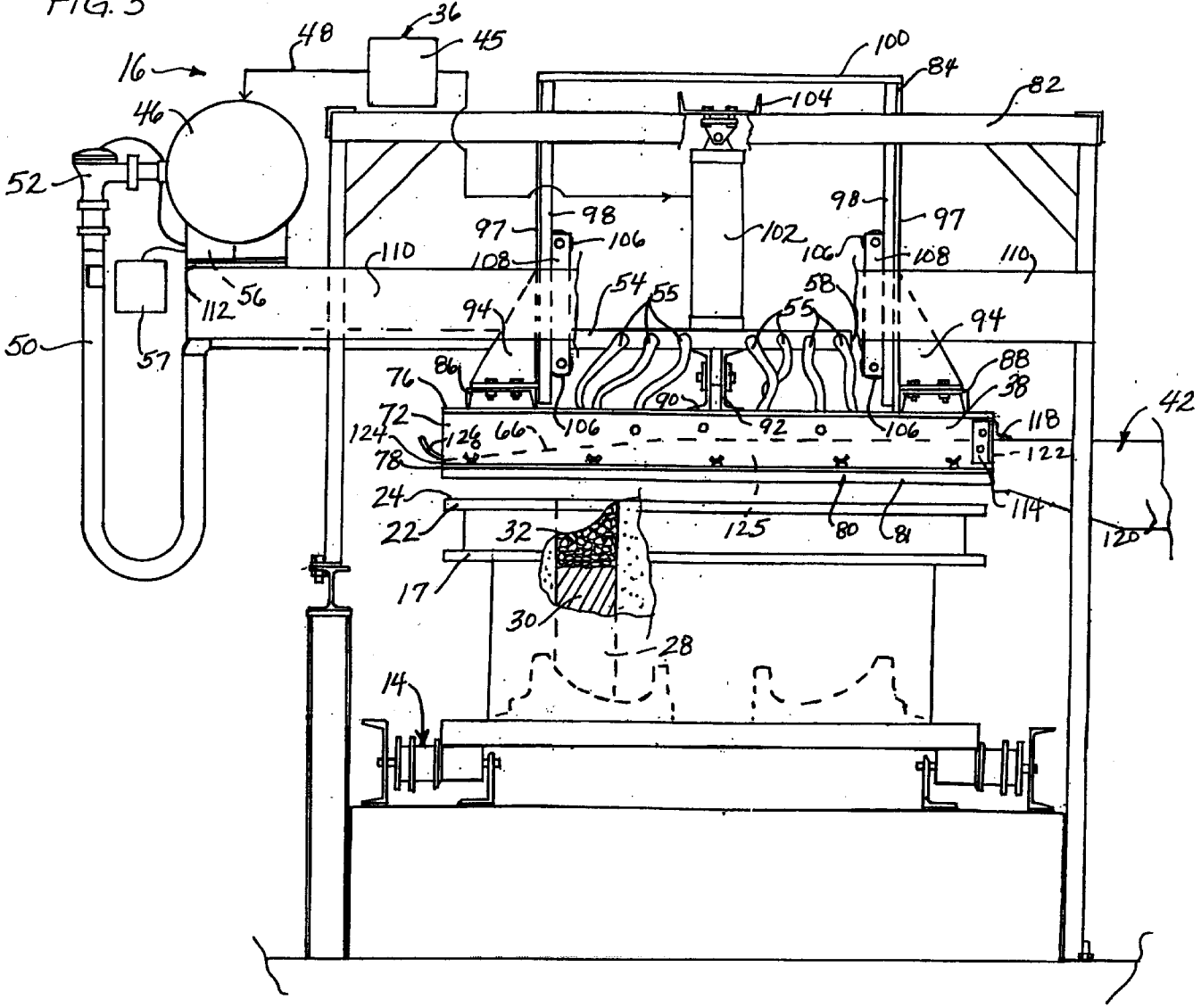
FIG. 3 is a side elevation of the riser topping gathering apparatus of FIG. 1, with a part of the cope mold portion shown in cross-section, and shown with the capture hood in a raised position.

In each riser cavity, the riser eventually solidifies, and remains in the cope mold portion 17 after the cast product has been removed, with the riser topping material resting on top of the metal riser. Examples of solid risers are shown at 30 in FIGS. 3 and 6, and riser topping is shown at 32 in FIGS. 3 and 6. As shown in FIG. 3, when the cope mold portion 17 is received at the riser topping gathering station 16, there is a quantity of riser topping 32 in the riser cavity 28 and on top of the riser 30. It should be understood that the other riser cavities 28 also include similar metal risers and similar quantities of riser topping. In each of the riser cavities, there is riser topping 32 between the solid metal riser 30 and the top 24 of the cope mold portion 17; there may also be some loose riser topping on the surface of the top 24 of the cope mold portion 17. The present invention provides a system and method for gathering this riser topping material from the cope mold portion.

Since it is desirable that the mold portions be processed quickly for reuse, there is little time for the risers and riser toppings to cool to ambient temperature before reaching the riser topping gathering station 16. Thus, when the cope mold portion 17 reaches the riser topping gathering station 16, the metal risers 30 are still typically at a high temperature, and the riser topping 32 is also typically at a high temperature. The riser topping 32 may be burning when the cope mold portion 17 reaches the riser topping gathering station 16, and the components of the riser topping gathering station 16 should be capable of being exposed to this high temperature material without suffering catastrophic damage.

In addition to the cope mold portion 17 with metal risers 30 and riser topping 32 in the riser cavities 28, the riser topping gathering system 34 of the present invention includes a high pressure air system 36, a capture hood 38 for gathering riser topping material from the cope mold portion 17, a primary collector 40 for collecting riser topping material, a duct system 42 and an air moving mechanism 44. All of these elements are shown schematically in FIG. 1A. For high temperature applications, the primary collector 40 should be made of non-flammable components; for other applications, a fabric filter dust collector may be employed.

An example of a high-pressure air system is shown in the illustrated embodiment. The illustrated high-pressure air system 36 comprises a plant supply of high-pressure air 45, such as available from a compressor or the like, and a compressed air tank 46. The compressed air tank 46 is connected to receive compressed air from the plant supply 45 through a suitable conduit 48. Another conduit 50 is connected to receive high-pressure air from the compressed air tank 46 through a valve 52. Suitable couplings and connectors are used in the illustrated embodiment to connect the tank 46 to the valve 52 and the valve 52 to the receiving conduit 50. In the illustrated embodiment, the receiving conduit 50 delivers the high-pressure air pulses to a manifold 54. The illustrated manifold 54 is connected to a plurality of flexible air hoses 55.

For the elements of the illustrated high-pressure air system 36, commercially available components may be used. For example, the compressed air tank 46 may be purchased from McMaster-Carr, of Atlanta, Ga., Chicago and Elmhurst Ill. and other locations, ASME-Code Horizontal Pressure Steel Tank part no. 9888K19. The valve 52 is a commercially available 1½ inch "Goyen" double diaphragm valve, available from Wheelabrator Canada, Inc. of Milton, Ontario, Canada, part no. 620337. The illustrated control box 56 is also commercially available from Wheelabrator Canada, Inc., part nos. RCA6V53, RCA5D2. It should be understood that all of these elements are identified for purposes of illustration only. The identified diaphragm valve and control box are the type that are typically used in bag houses in factories to provide short bursts of air during a cleaning cycle in the bag house. Other devices that provide periodic short bursts of high-pressure air may be used. In addition, it may be desirable to use another source of high-pressure air that delivers the air over longer times or in different manners. The present invention is not limited to any type of high pressure air delivery system or any particular components for such a system unless expressly set forth in the claims.

Figure 5:
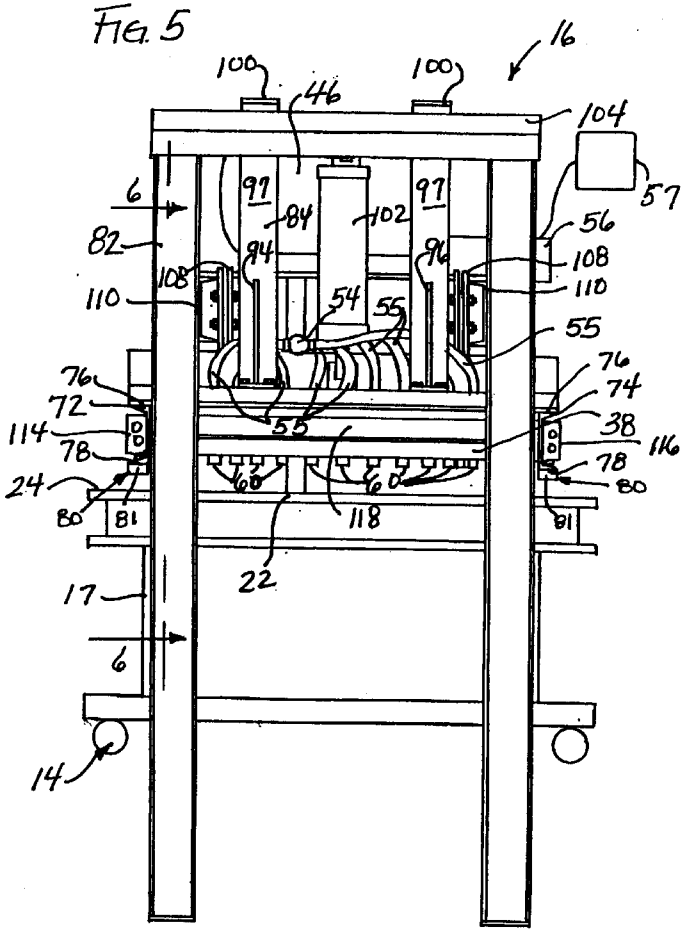
FIG. 5 is a back elevation of the riser topping gathering apparatus of FIGS. 2–3, shown with the duct system removed for clarity of illustration.

In the illustrated embodiment, the control box 56 is connected to receive electrical input from a programmable logic controller (PLC). A PLC is shown schematically at 57 in FIGS. 3–5. The PLC 57 may be connected to receive inputs from various sources, such as a limit switch (not shown) that senses when the cope mold portion 17 is in position below the capture hood 38. A commercially available PLC may be used. It is expected that the supplier would be consulted for selection of an appropriate model of component. A standard PLC with standard logic may be programmed by one skilled in the programming art, such as an electrical engineer, or more sophisticated programming could be developed if desired. It should be understood that the use of a PLC is identified for purposes of illustration only, and that the invention is not limited to use of PLCs, or to any particular program, computer or PLC.

In the illustrated embodiment, the receiving conduit 50 includes a standard flexible 1½ inch diameter hose with a length of about 7 feet. The manifold is a steel pipe, 1½ inch diameter and 5 feet long. The illustrated manifold has 14 holes bored through its outer wall; at each hole a pipe coupling is welded to the pipe. These couplings receive barbed hose couplings that serve as connecting mechanisms for the flexible air hoses 55. One end of each flexible air hose 55 is connected to receive high-pressure air through one opening in the manifold. One end of the manifold is connected to the conduit 50, and the opposite end 58 is closed with an end cap welded to the pipe. Thus, high pressure air can flow from the compressed air tank 46 through the valve 52 to the conduit 50, through the conduit 50 to the manifold 54, and through the manifold to each of the flexible air hoses 55. Each air hose 55 has a second end that is connected to a high-pressure air outlet 60, shown in FIG. 6. The high-pressure air outlets 60 are all part of the capture hood 38 of the riser topping gathering system.

In the illustrated embodiment, as shown in FIG. 6, each high-pressure air outlet 60 comprises a nozzle made by drilling a ⅛-inch diameter hole in a standard ¾-inch diameter steel cap. It should be understood that other air outlets or nozzles may be used, such as conical-shaped nozzles or small diameter conduits, for example, and the invention is not limited to any particular shape or material for the air outlets unless expressly set forth in the claim.

The above description of elements from the tank to the high pressure air outlets 60 should be understood as providing an example only of a system for delivering high pressure air to the capture hood. The invention is not limited to any of the elements described unless expressly set forth in the claims.

In the illustrated embodiment each end cap defining the high-pressure air outlet 60 is connected to an upwardly extending ¾-inch pipe nipple 62. The upper end of each pipe nipple 62 is received in a ¾-inch pipe coupling 64. Each pipe coupling 64 is received in a bore in a top member 66. The top member 66 comprises a ¼-inch thick steel plate in the illustrated embodiment, and each pipe coupling 64 is welded to the top surface of the steel plate. Hose connectors 68 extend upward from most of the pipe couplings 64, above the top surface of the top plate member 66; one or more of the high pressure air flow paths may include an elbow 70 between the coupling 64 and the hose connector 68. Each flexible air hose 55 is attached to one of these hose connectors 68 to deliver air to the high-pressure air outlets 60. It should be understood that this assembly is provided as an example only and that the invention is not limited to use of these elements unless expressly called for in the claims. Other means may be used to secure the high-pressure air outlets in predetermined positions on the capture hood.

The capture hood 38 also includes two sides 72, 74 with tops 76 and bottoms 78. In the illustrated embodiment, each side member 72, 74 comprises a steel channel that runs along substantially the entire length of the capture hood 38. The interior sides of each channel is connected to two angles used to mount the capture hood top member 66 to the side members 72, 74. These two angles are shown at 73 and 75 in FIG. 6.

The bottom 78 of each side member 72, 74 is connected to a gasket assembly 80. Each gasket assembly 80 runs the length of the respective side member 72, 74. Each illustrated gasket assembly includes a steel top plate ⅛ inch by 2 inches by 4 feet 7½ inches, and a compressible rubber gasket strip 1 inches by 2 inches by 4 feet 7½ inches. The illustrated gasket strip, shown at 81 in FIG. 8, is commercially available from Gaskets, Inc. of Rio, Wis., part no. G/1-SHS-5, silicone closed cell foam. The gasket assembly is removably attached to each side member 72, 74 through bolts and wing nuts in the illustrated embodiment. It should be understood that the details of the side members and gaskets are provided by way of example only, and that the present invention is not limited to the described side members and gasket assemblies or to use of such elements unless expressly called for in the claims. In addition, while use of the gasket assemblies generally improves efficiency by sealing parts of the capture hood against ambient air, the system could be operated without this seal if desired. However, as described below, the gasket assembly also seals against the cope mold portion to prevent riser topping material from exiting into the plant environment.

Generally, the high pressure air outlets should be positioned on the capture hood 38 so that high pressure air is efficiently delivered into each riser cavity, and so that the means selected for delivering the high pressure air into the riser cavities do not damage and are not damaged by the top 24 of the cope mold portion 17. In the illustrated embodiment, these ends are achieved by positioning a high pressure air outlet vertically over each riser cavity and by positioning the high pressure air outlets so that they do not extend below a horizontal plane through the bottoms 78 of the side members 72, 74. However, variations are possible: for example a flexible nozzle could be provided that could extend into the riser cavity; vertical movement could be possible to extend the high pressure air outlets down closer to or into the riser cavities, or one high pressure air outlet could be positioned or moved to deliver high pressure air to more than one riser cavity. Other variations are possible and within the scope of the invention unless expressly excluded.

Generally, it is desirable that the capture hood 38 or at least parts of it be vertically movable to accommodate cope mold portions 17 of different heights and to be raised out of the path of the cope mold portion when it is received at the riser topping gathering station 16 and to be lowered into an operational position juxtaposed with the top of the cope mold portion when the cope mold portion is in position at the station 16. In the illustrated embodiment, vertical movement and support of the capture hood 38 is provided by a stationary frame 82 and a vertically movable frame 84. Examples of a stationary frame 82 and vertically-movable frame 84 are shown in the drawings and described below; however, it should be understood that these structures are illustrated and described by way of example only, and that the invention is not limited to use of the illustrated structures unless expressly set forth in the claims. In addition, it should be understood that the invention is not limited to a vertically movable capture hood unless expressly set forth in the claims. Other structures are possible: for example, the conveyor 14 may include structures that allow the cope mold portion to be raised to contact the capture hood, or the system could be designed so that the capture hood or cope mold portion moves horizontally over or under the other.

Figure 4:
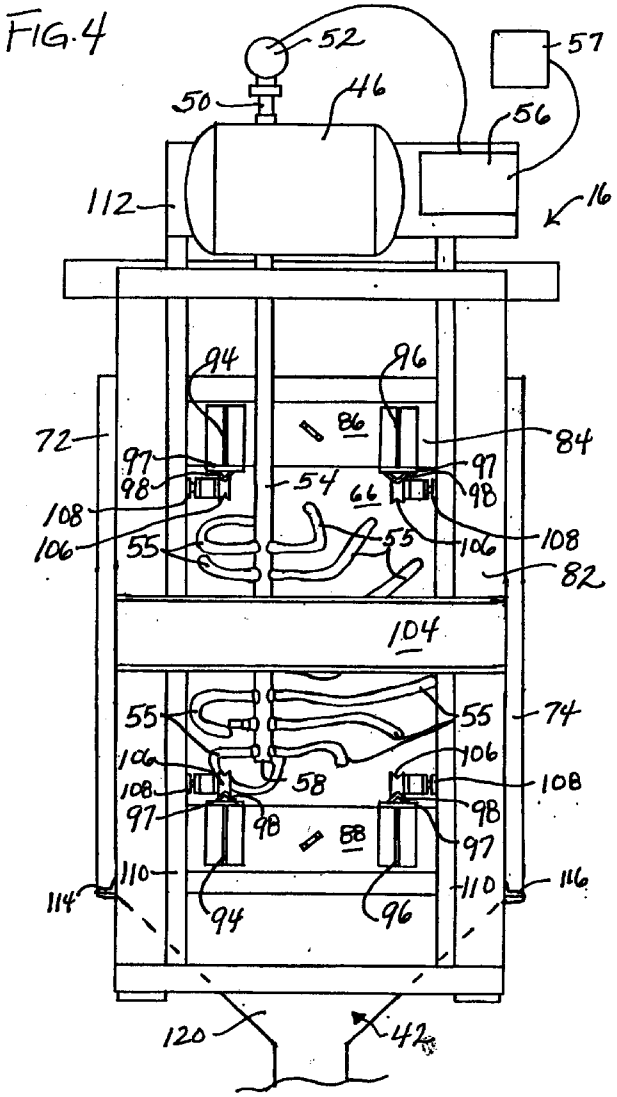
FIG. 4 is a top plan view of the riser topping gathering apparatus of FIG. 3.

In the illustrated embodiment, the vertically-movable frame 84 includes a pair of outer channel members 86, 88 extending transversely across and connected to the tops 76 of the side members 72, 74 of the capture hood 38. A pair of closely spaced central channel members 90, 92 also extend transversely across and are connected to the tops 76 of the side members 72, 74 of the capture hood 38. The outer channel members 86, 88 are each connected to a pair of vertical steel braces 94, 96 that extend upward from the outer channel members 86, 88. Each vertical brace 94, 96 is connected to a vertical plate 97 that is connected to a vertical angle 98. The corner of each angle 98 is exposed and runs vertically. The tops of opposite vertical plates 97 may be connected by a longitudinal brace 100. In FIG. 4, the longitudinal braces 100 are removed for clarity of illustration.

The central channels 90, 92 are pivotally connected to a vertical movement mechanism. In the illustrated embodiment, the vertical movement mechanism is an air cylinder. It should be understood that this mechanism is shown for purposes of illustration only, and that the invention is not limited to use of an air cylinder; a hydraulic cylinder could be used or some combination of mechanical elements could be used to raise and lower the capture hood.

As shown schematically in FIG. 3, the air cylinder 102 may be connected to the plant air supply 45. Also as shown in FIG. 3, one end of the air cylinder 102 is pivotally connected to the central channel members 90, 92 and the other end of the air cylinder 102 is pivotally connected to a transverse channel member 104 that is part of the stationary frame 82. The air cylinder 102 may be a commercially available one, such as one available from Parker-Hannifin Corporation of Cleveland, Ohio, Series 2A Heavy Duty Pneumatic Cylinder, 5 inch bore, 14 inch stroke, with appropriate mounting hardware. This air cylinder is identified for purposes of illustration only; the invention is not limited to this particular air cylinder or to the use of air cylinders unless expressly set forth in the claims.

In the illustrated embodiment, the air cylinder 102 is used to move the capture hood 38 and vertically-movable frame vertically toward and away from a cope mold portion 17 on the conveyor 14 below the capture hood 38. To guide the vertical movement of the vertically movable frame 84 and capture hood 38, the stationary frame 82 includes sets of V-rollers 106 mounted on mounting brackets 108. The mounting brackets 108 are fixed to horizontal channels 110 of the stationary frame 82. The vertical angles 98 of the vertically movable frame 84 travel in the grooves of the V-rollers. The V-rollers are commercially available from the Osborne International unit of Jason Incorporated of Cleveland, Ohio as stud style roller part no. VLR-2-½. It should be understood that this guiding system is provided by way of example only, and that the invention is not limited to these components unless expressly set forth in the claims.

In the illustrated embodiment, the stationary frame 82 also includes a horizontal plate 112 that is fixed to the tops of the horizontal channels 110. The horizontal plate 112 supports the compressed air tank 46 and control box 56. It should be understood that the invention is not limited to providing such a plate unless expressly set forth in the claims.

The capture hood 38 of the illustrated riser topping gathering system 34 also includes a pair of brackets 114, 116 attached to one end of the side members 72, 74, and a transverse mounting angle 118 that extends across back of the capture hood from one side member 72 to the other side member 74. The brackets 114, 116 and angle member 118 serve to provide mounting supports for the duct system 42.

As shown in FIGS. 3–4 and 6, a funnel-shaped duct member 120 is mounted to the angle member 118 and brackets 114, 116 at one end of the capture hood 38. The funnel shaped duct member 120 extends transversely across the entire capture hood 38, from side member 72 to side member 74, from below the bottoms 78 of the side members 72, 74 to the top member 66 of the capture hood. This end of the capture hood defines an exit for ambient air to travel from the capture hood to the duct system 42; this ambient air exit is shown at 122 in FIG. 6. It should be understood that the ambient air exit 122 also serves as an exit for high pressure air that has been delivered into the riser cavities and for riser topping material that has been lifted out of the riser cavities. Thus, the expression "ambient air exit" should be understood to include ambient air and may also include high pressure air and riser topping material that exits the capture hood into the duct system, as in the illustrated embodiment of the invention.

The capture hood 38 also has an ambient air entry 124 opposite from the ambient air exit 122. The ambient air entry 124 is separated from the ambient air exit 122 by the two gasket assemblies 80. When the capture hood 38 is lowered to place the gaskets of the gasket assemblies 80 against the top surface 24 of the cope mold portion 17 as shown in FIG. 6, an air flow path 125 is defined from the ambient air entry 124 into the capture hood 38 below the top member 66 and over the top 24 of the cope mold portion. In the illustrated embodiment a curved transverse vane 126 is provided across the capture hood at the ambient air entry 124 to guide the ambient air stream into the interior of the capture hood. It should also be understood that the term "ambient air" is used herein to refer to the air in the plant around the capture hood 38, it should be understood that the term is not limited to such plant air, but may include, for example, air delivered to the ambient air entry 124 from a source such as an air treatment or cooling system or air from outside the plant, or combinations of such sources of air.

As shown in FIG. 6, the airflow path 125 within the capture hood 38 expands from the ambient air entry 124 toward the interior of the capture hood. That is, the transverse cross-sectional area of the airflow path 125 is smallest at the ambient air entry 124 and increases toward the center of the capture hood 38. The cross-sectional area of the airflow path is then constant up to the ambient air exit 122.

As shown in FIG. 1, in the illustrated embodiment the duct system 42 leads from the ambient air exit 122 of the capture hood 38 to the primary collector 40. From the primary collector 40, in the illustrated embodiment the duct system 42 leads to a secondary collector 130 and from the secondary collector 130 to the air moving mechanism 44. The air moving mechanism 44 can be connected to either the duct system 42 or the collector 40 to move an ambient air stream into the ambient air entry 124 of the capture hood, though the ambient air flow path 125, out the ambient air exit 122, into the duct system 42 and to the collector 40.

At least part of the duct system should be a flexible duct to allow at least part of the duct system to move with vertical movement of the capture hood. As shown in FIG. 1, the duct section shown at 131 is flexible. A suitable flexible duct section may comprise a metal hose. Examples of suitable flexible metal hoses include 5 foot lengths of 6 inch inner diameter galvanized medium weight metal hose #5495K35, 6 inch inner diameter standard gauge stainless steel hose #5241K72 or 6 inch inner diameter heavy gauge stainless steel hose, all available from McMaster-Carr, of Atlanta, Ga., Chicago and Elmhurst Ill. and other locations. The other sections of the duct system may be made of standard metal materials. All of these elements are identified for purposes of illustration only, and the present invention is not limited to any size or type of element unless expressly called for in the claims. Generally, the materials selected should be capable of withstanding the transport of high temperature air and riser topping material. The sizes and shapes of the ducts may be selected to control the speed of movement of the stream of air and riser topping material to maximize the useful life of the duct system or for some other desired parameter.

The primary collector 40 may be any commercially available separator device that meets the technical requirements for design parameters such as pressure and volume. In addition, for a system gathering high temperature materials, the primary collector 40 should be of all metal construction to reduce the risk of fire. For other applications, if there is no risk of fire, a fabric filter dust collector may be used. The primary collector 40 shown in FIG. 1 has a collection chute 146 leading to a discharge collector or hopper 148 that may be provided beneath the floor of the factory, for example, or in any other suitable location. The air stream may be drawn off from the primary collector 40 through an exhaust duct and delivered by that duct to an inlet of the secondary collector 130 for further processing. The secondary collector 130 may comprise a standard baghouse dust collector, utilizing a plurality of filter bags (not shown) through which the air stream is drawn. The waste riser topping material and dust may then fall through a secondary discharge collection chute 150 to a discharge collector, which may be common with the discharge collector 148 of the primary collector 40.

An example of a suitable primary collector is a commercially available collector from Airotech, Inc. of Pittsburgh, Pa., Model M1060WHS (Special) No. 2–6 Tubular Dust Collector, Organ Pipe Design. It should be understood that this primary collector is identified for purposes of illustration only, and that the invention is not limited to this particular collector or to this particular type of collector unless expressly set forth in the claims. For example, a commercially available cyclonic collector could also be used.

A suitable secondary collector 130 is available from American Vacuum Company of Skokie, Ill., type 48×96 Cyclone (Model 48FR96). However, the invention is not limited to this device or this type of device unless expressly set forth in the claims.

The illustrated system using a primary collector 40 and secondary collector 130 may be modified by omitting some elements, such as by using only a single collector, or a two stage single collector, or the like. However, if there is a risk of fire, the collector or collectors used should be non-flammable and suitable for high temperature applications. As used herein, "collector" encompasses a single device or apparatus by which the riser topping materials may be separated or filtered from the air stream and collected or accumulated together, as well as more than one device or apparatus for accomplishing this result.

The air-moving mechanism 44 may comprise a single fan and drive motor, drawing clean air from the secondary collector 130 through an outlet duct and discharging the clean air through a clean air outlet duct 152. The preferred air flow velocities and volumetric flow rates are described below following the description of the method of the present invention. A suitable drive fan and motor are available from American Vacuum Company, Model 1214-3-1-AD cast centrifugal vacuum exhauster direct driven by a 40 hp Reliance TEFC premium efficiency motor. It should be understood that other air moving mechanisms may be used, and that the invention is not limited to this mechanism or this type of mechanism unless expressly set forth in the claims.

The riser topping gathering system may be made by assembling the above-described components.

The riser topping gathering system may be used in the method of the present invention. The method involves providing a cope mold portion 17 with a top 24 having one or more openings 26 and a riser cavity 28 aligned with each opening 26. A metal riser 30 is in the riser cavity 28 and riser topping material 32 is above the metal riser 30. After the presence of the cope mold portion has been sensed and a signal sent to the PLC 57, the air cylinder 102 is activated to lower the capture hood 38 and vertically movable frame 84 downward until the gaskets 81 rest on the top 24 of the cope mold portion 17. The PLC 57 may then signal the controller 56 to activate the valve 52. Once the valve 52 is activated high pressure air from the compressed air tank 46 is delivered in a burst or pulse from the valve 52 to the conduit 50, and from the conduit 50 to the manifold 54. From the manifold, the burst or pulse of high-pressure air is delivered to the air hoses 55, and from the air hoses, the bursts or pulses of high-pressure air exit through the high pressure air outlets 60. The high pressure air is delivered at around 80 psi from the tank 46 as are the bursts of air delivered from the high pressure air outlets 60. It should be understood that although the expression "high pressure air" is intended to include air at pressures of around 80 psi, the expression is not limited to that pressure. The expression "high pressure air" should be understood to include typical plant compressed air systems operating at 80–120 psi., and should also be understood to encompass air pressures that can move into the riser cavities and activate the riser topping material in the riser cavities and raise the activated riser topping material out of the riser cavities and into the air flow path 125.

The high-pressure air pulses delivered from the outlets 60 are shown in FIG. 6, and some have been identified with reference number 160. As can be seen, the high pressure air pulses 160 travel down into the riser cavities 28 and are reflected back up into the air flow path 125. This air stream 160 activates and raises the riser topping material 32 out of the riser cavities 28. In addition, the high-pressure pulses are preferably of suitable pressure to cause riser topping material on the top surface of the cope mold portion to become air-borne.

In the illustrated embodiment, the PLC 57 and control box 56 are set to operate the valve 52 in short pulses of 50 milliseconds. The system has been found to be effective in gathering rice hull riser topping materials when four pulses of 80 psi air, each lasting 50 milliseconds, with two seconds between pulses. The first pulse is released two seconds after the capture hood 38 contacts the top 24 of the cope mold portion 17, and the capture hood 38 is raised two seconds after the fourth pulse stops.

Throughout the entire time that the capture hood 38 is in contact with the cope mold portion 17, the air moving mechanism 44 is operating to pull a stream of ambient air into the ambient air entry 124 of the capture hood 38, through the air flow path 125, out the ambient air exit 122, into the duct system 42, though the collectors 40, 130 and to move the air out through the outlet duct 152. This stream of ambient air is shown generally at 162 in FIG. 6. As can be seen from FIG. 6, as the high pressure air stream 160 lifts the riser topping material 32 into the air flow path 125, the lower pressure ambient air stream 162 carries or moves the riser topping material 32 out through the ambient air exit 122 and into the duct system 42. The riser topping material 32 is carried with the air stream 162 through the duct system 42 and is separated from the air stream at the collectors 40, 130. The separated riser topping material 32 drops through the collection chutes 146, 150 and is gathered in the discharge collector 148.

At the end of the cycle, the capture hood 38 and vertically movable frame 84 may be raised through operation of the air cylinder 102. The cope mold portion 17 may then be moved downstream to the next workstation 18 for removal of the metal risers.

Several of the details of the illustrated embodiment of the invention relate to the fact that the riser topping material is at a high temperature when gathered. When the high pressure air is pulsed into the system, sparks are created in the ambient air flow path 125. If not accounted for, these sparks can give rise to problems in the plant: a fire ball could be created that could escape to the plant; the standard bag house collector 130 could be damaged from the sparks and from material ignited by the sparks; and the fire could create high pressure that could force burning material out of the ambient air inlet 124. These problems are addressed in the illustrated embodiment in several ways. First, the total air volume moving through the capture hood 38 exceeds the volume of air pulsed into the system through the outlets 60; that is, the volumetric flow rate of the ambient air stream exceeds the volumetric flow rate of the high pressure air pulses. Second, the top member 66 of the collection hood 38 is shaped to provide a small cross-section ambient air entry and an expanding transverse cross-sectional area within the capture hood so that a high velocity ambient air stream is at the ambient air entry 124 so that air, dust, sand and riser topping material does not back flow out through the ambient air entry into the plant environment. This design should also increase the collection efficiency by controlling the velocity and pressure of the ambient air stream 162 as it enters and travels through the capture hood. Third, the timing sequence described above provides several advantages: the initial flow of ambient air through the path 125 picks up riser topping material from the top surface 24 of the cope mold portion 17 to create a clean environment in the path 125 from the air entry 124 to at least the area of maximum cross-section before the high pressure air is pulsed into the system; thus, the timing sequence serves to minimize the amount of material that could be ignited by the sparks caused by the high pressure air pulses. In addition, the two second delay before commencing the high pressure air pulses allows time for the capture hood 38 to seal against the top 24 of the cope mold portion 17 to ensure that burning material does not escape into the plant environment; and the two second delays between high pressure pulses allow for some cooling of the system as ambient air is continuously drawn through the capture hood, duct system and collectors.

In addition, as shown in FIGS. 3 and 6, since the bottom of the funnel-shaped duct member 120 is below the level of the gaskets 81 and below the level of the top 24 of the cope mold portion 17, all of the ambient air stream 162 should enter the duct 120, and no burning material should enter the plant environment. The two-second delays between high pressure air pulses allows for a cooling ambient air stream to be drawn into the system between pulses. And in the illustrated embodiment, the air moving mechanism 44 operates continuously to cool the primary collector 40 and the duct system 42.

The system of the present invention allows for efficiencies in the sizing and operation of the air-moving mechanism. With the pulsing high pressure air streams, smaller air velocities and volumes for the ambient air streams 162 are needed. Generally, the high pressure air pulses move the riser topping material out of crevices and off of the top 24 of the cope mold portion and into the path of the air stream 162 above the top 24 of the cope mold portion 17 wherein the airborne riser topping materials may be moved more efficiently.

Generally, the air moving mechanism 44 will be selected and set to operate at speeds depending on factors such as the density and particle size of the riser topping material. In addition, the air moving mechanism can be selected and set to operate, in coordination with the size of ductwork, to move the air and riser topping material through the duct system at speeds that reduce wear and tear on the duct system. The ambient air velocities may be on the order of about 4,200 feet per minute at the ambient air intake 124 and at about 2,100 feet per minute at the tallest cross section of the capture hood 38. These air velocities are generally substantially less than one would need to pick up static riser topping material from the top of the cope mold portion. Capital costs can thus be saved in using a smaller fan and smaller ducts and collector or collectors. Operational costs may also be saved since the fan is run at a lower horsepower when used in combination with the high pressure pulses.

At the above-described velocities, the riser topping gathering system may also advantageously collect heavier bulk density materials along with the riser topping materials. The pulses of high pressure air can activate loose core sand and dust in the riser cavity and on the top surface of the cope mold portion, and lift these materials into the ambient air stream 162. Thus, the ambient air stream 162 flowing through the capture hood and entering the duct system 42 may carry or move the high pressure air delivered by the high pressure air oulets 60, the ambient air that enters through the ambient air entry 124, the riser topping material 32, sand and dust. A volumetric flow rate of about 2400 cubic feet per minute for the ambient air stream should carry the riser topping material and the heavier sand. However, it should be understood that the present invention is not limited to a system or method that gathers all of the riser topping, sand and dust unless expressly set forth in the claims. In addition, the invention is not limited to any particular velocity or volumetric flow rate unless expressly set forth in the claims.

It should be understood that the principles of the present invention may also be applied to collection of other loose material, at this station in the production system as well as at other stations. For example, it may be desirable to apply the principles of the present invention to a loose material gathering system and method employed to clean the assembled mold before it enters the casting station.

While only specific embodiments of the invention have been described and shown, it is apparent that various alterations and modifications can be made therein. For example, for low temperature applications, it is apparent that several of the fire safety and cooling features could be modified or eliminated. It is, therefore, the intention in the appended claims to cover all such modifications and alterations as may fall within the scope and spirit of the invention.

We claim:

1. A gathering system comprising:

a cope mold portion having a top with an opening, a riser cavity aligned with the opening in the top and extending down from the top, a solid metal riser in the riser cavity and riser topping in the riser cavity between the solid metal riser and the top of the cope mold portion;

a high-pressure air system;

a capture hood for gathering material from the cope mold portion, the capture hood overlying at least part of the cope mold portion and including an ambient air entry, an ambient air exit, an ambient air flow path over the top of the cope mold portion, and a high pressure air outlet connected to the high pressure air system and positioned to deliver high pressure air into the riser cavity of the cope mold portion, the high pressure air outlet being separate from the ambient air exit;

a collector;

a duct system extending from the ambient air exit of the capture hood to the collector; and an air moving mechanism connected to at least one of the duct system and the collector for moving an ambient air stream into the ambient air entry of the capture hood, through the ambient air flow path over the top of the cope mold portion, through the ambient air exit of the capture hood, into the duct system and to the collector.

2. The gathering system of claim 1 wherein the cope mold portion has a plurality of riser cavities and the top of the cope mold portion has a plurality of openings, each opening aligned with one riser cavity, and wherein the capture hood has a plurality of high pressure air outlets positioned to deliver high pressure air into one riser cavity of the cope mold portion.

3. The system of claim 2 wherein the high pressure air path includes a manifold and a plurality of air hoses leading from the manifold, each air hose leading from the manifold to one high pressure air outlet.

4. The system of claim 1 wherein the capture hood has two sides with tops and bottoms and a top member, the bottom of each side including a gasket positioned against the top of the cope mold portion, the ambient air entry being between the gaskets and the ambient air exit being between the gaskets and spaced from the ambient air entry, the ambient air flow path being between the top member of the capture hood and the top of the cope mold portion.

5. The system of claim 4 wherein the cross-sectional area of the ambient air entry is less than the cross-sectional area of the ambient air exit and wherein the cross-sectional area of the ambient air flow path increases between the ambient air entry and the ambient air exit.

6. The system of claim 1 wherein the high-pressure airflow path includes a valve downstream of the high-pressure air source.

7. The system of claim 1 further including a stationary frame and a vertically movable frame, the capture hood being connected to the vertically movable frame.

8. A method of gathering riser topping material from a cope portion of a mold comprising the acts of:

providing a cope mold portion with a top having an opening and a riser cavity aligned with the opening, a metal riser in the riser cavity and riser topping material above the metal riser;

moving a first stream of air over at least a part of the top of the cope mold portion;

delivering a second air stream into the riser cavity to raise at least a portion of the riser topping material out of the riser cavity and into the path of the first air stream;

the first air stream moving the raised riser topping material away from riser cavity.

9. The method of claim 8 wherein the second air stream is delivered into the riser cavity in a pulse simultaneously with movement of the first air stream.

10. The method of claim 8 wherein the second air stream is delivered in a series of separate pulses.

11. The method of claim 8 wherein the first air stream is moved from a time before the first pulse until a time after the last pulse of the series of pulses.

12. The method of claim 10 wherein the second air stream is pulsed into one riser cavity for about 50 milliseconds and then stopped for about 2 seconds, pulsed again for about 50 milliseconds into the same riser cavity and then stopped for about 2 seconds, pulsed again for about 50 milliseconds into the same riser cavity and then stopped for about 2 seconds, and then pulsed again for about 50 milliseconds into the same cavity and then stopped, the first air stream moving throughout the pulses of the second air stream.

13. The method of claim 12 wherein the cope mold portion is then moved to a downstream workstation.

14. The method of claim 13 further including the act of casting a steel railway wheel in the mold before gathering the riser topping material.

15. The method of claim 8 wherein the cope mold portion has a plurality of riser cavities and wherein the method includes the act of delivering an air stream into each riser cavity.

16. The method of claim 8 wherein the first air stream has a lower pressure than the second air stream.

17. The method of claim 8 further including providing a capture hood and moving the capture hood over the top of the cope mold portion, and wherein the acts of moving the first stream and pulsing the second air stream take place after the capture hood is moved over the top of the cope mold portion.

18. The method of claim 8 wherein the first air stream moves at a velocity of at least 2000 feet per minute over at least part of the top of the cope mold portion.

19. The method of claim 18 wherein the first air stream moves at a velocity of between about 2,100 and 4,200 feet per minute over the top of the cope mold portion.

20. The method of claim 8 wherein the first air stream includes riser topping material, sand and dirt.

* * * * *